United States Patent [19]

Beattie et al.

[11] Patent Number: 4,777,880

[45] Date of Patent: Oct. 18, 1988

[54] BLASTING METHOD WITH ABOVE AND BELOW SURFACE DELAYS

[75] Inventors: Timothy A. Beattie; Stewart G. Hamilton, both of Victoria; Mark A. Irving, New South Wales; Barry K. Miskin, Victoria, all of Australia

[73] Assignee: ICI Australia Limited, Victoria, Australia

[21] Appl. No.: 35,012

[22] Filed: Apr. 6, 1987

[30] Foreign Application Priority Data

Apr. 10, 1986 [AU] Australia ..... PH5405

[51] Int. Cl.[4] ..... F42B 3/00

[52] U.S. Cl. ..... 102/312; 102/313; 102/202; 102/217

[58] Field of Search ..... 102/202, 215, 217, 218, 102/312, 313

[56] References Cited

U.S. PATENT DOCUMENTS 3,934,514 1/1976 Dawkins ..... 102/217
4,063,509 12/1977 Leonard et al. ..... 102/313 X
4,324,182 4/1982 Kirby et al. ..... 102/217
4,409,897 10/1983 Kirby et al. ..... 102/200
4,419,933 12/1983 Kirby et al. ..... 102/206
4,487,125 12/1984 Zuk ..... 102/206 X
4,493,259 1/1985 Munzel ..... 102/11 X

*Primary Examiner*—Peter A. Nelson
*Attorney, Agent, or Firm*—Cushman, Darby & Cushman

[57] ABSTRACT

A method of detonating explosive charges for the breaking of rock and ore comprises the use of two sets of components, one set within the explosive charge and the other set at the surface of the explosive. The set within the exposive comprises a detonator, a first delay element and a passive energy storage device such as a capacitor. The second set which is able to communicate with the first comprises a power source, a second delay element and a means for receiving signals from a remote command source. In a preferred embodiment, the first delay element has a fixed delay and the second delay element has a programmable delay.

The method permits of versatility and precision in the use of explosives, using relatively inexpensive components.

12 Claims, 1 Drawing Sheet

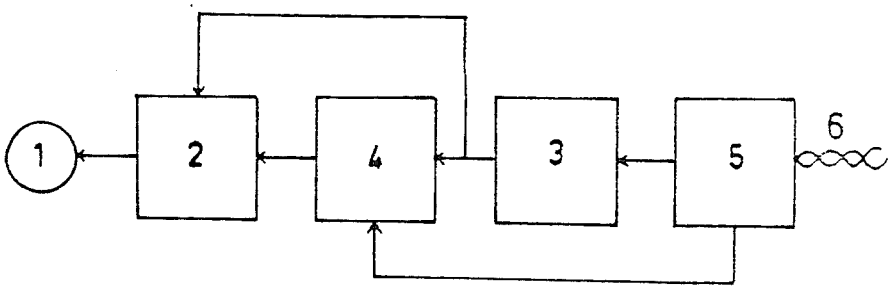
1
2
4
3
5
6
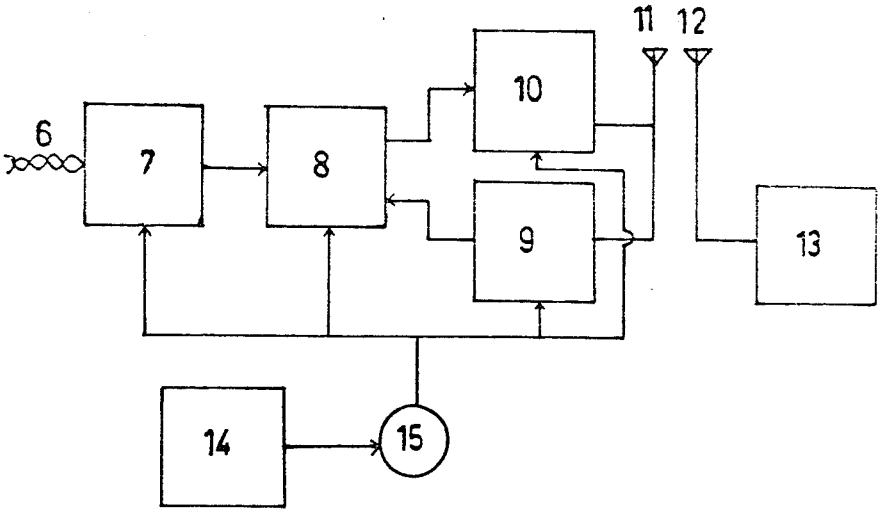
11
12
10
6
7
8
9
13
14
15

BLASTING METHOD WITH ABOVE AND BELOW SURFACE DELAYS

This invention relates to a method of blasting.

The efficient breaking of rock and ore by means of explosives demands considerable skill and know-how on the part of practitioners. Explosive charges are laid in predetermined quantities and are exploded in a predetermined pattern at precise intervals by means of detonators within the explosive. Desirable precision has only really been attainable since the introduction of electrical firing. In such firing, the firing signal is given to the various detonators by means of electrical wiring linking the firing position with the detonators, and the detonators have built-in delays such that the last charge to explode has received its firing signal before the first explosion. This, however, means that a large inventory of detonators of different delays must be kept, and that once these detonators are in place, the blast pattern cannot be altered.

One proposed answer to these problems is to provide each detonator with an electronic programmable delay which can be programmed prior to detonation by signals sent from a central command point via electrical wiring or by a "wireless" means such as radio or electromagnetic induction. A major handicap is the fact that such a detonator must have a power source (generally a battery)—the presence of such a source in a charge of explosive is limiting because of its definite lifetime and the inability to replace it; it may also constitute a potential hazard.

An example of the detonator which seeks to overcome these problems is to be found in PCT published Application WO 87/00264, wherein is described a detonator which has a delay which is electronically programmable. The detonators described in this document are preferably modular, one of the possible modules being a power source such as a capacitor. This power source can charged up immediately prior to firing and provides the power for operating the delay and firing the detonator. One basic problem with such a detonator is that they are relatively expensive, and expense is a big factor when blasts involving hundreds or even thousands of charges are being contemplated.

We have now found that it is possible to provide a versatile, cheap, safe and precise means of detonating explosives, one which overcomes many or even all of the disadvantages of the known art. We therefore provide according to the present invention a method of blasting wherein an explosive is detonated by detonation means responsive to a firing signal from a remote command source, the detonation means comprising (a) within the explosive a detonator, a first delay element associated therewith and capable of actuating the detonator at a prescribed time after receiving the firing signal and a passive power storage device; (b) at the surface of the explosive a power source, a means for receiving signals, and a second delay element associated therewith and capable of delaying the time between receipt of the firing signal at (b) and detonation, and (c) means for communicating signals from (b) to (a).

We further provide a blasting apparatus for use in the firing of an explosive charge, the apparatus comprising (a) within the explosive a detonator, a first delay element associated therewith capable of actuating the detonator at a prescribed time after receiving the firing signal, and a passive power storage device, (b) at the surface of the explosive a power source, a means for receiving signals, and a delay element associated therewith and capable of delaying the time between receipt of the firing signal at (b) and detonation, and (c) means for communicating signals from (b) to (a).

The method of the present invention permits considerable versatility in all aspects of blasting. The detonators and charges can be laid and left for a considerable time before firing, without there being any danger of premature accidental detonation or deterioration with age of any buried detonation component.

The method of this invention involves the use with each explosive charge of two sets of components, the components (a) within the explosive and the components (b) at the surface of the explosive. By "at the surface of the explosive" we mean that the components (b) are at the ground surface or rock face and in close proximity to the charge with which they are associated. They may be physically on top of the explosive of the charge or they may be on the ground near the charge. The important thing is that the components (b) be readily accessible for the purposes of communication, or for maintenance or replacement of components.

The detonators for use in this invention can be any of those known to the art, for example, conventional bridgewire detonators, exploding bridgewire detonators and flying plate ("slapper") detonators.

The first delay element associated with the detonator may be one of the many types of delay known to the art, for example, the simple pyrotechnic delay which is often integral with its associated detonator. It may also be electronic; it may be, for example, a sophisticated actuator such as that described in PCT Published Application No. WO 87/00264 and WO 87/00265. However, one of the strengths of this invention is that relatively unsophisticated (and therefore inexpensive) components can be used in its performance. For example, the first delay element may be an electronic type whose delay is fixed; such delays are cheaper than programmable ones, and their use in large numbers is more financially acceptable. By "passive power source" we mean a power source which is capable of delivering power only when it itself is acted upon by an external stimulus. Thus, a conventional battery with a remotely activatable on-off switch is not a passive power source as the battery is always capable of delivering power. Indeed, such an arrangement negates one of the advantages of our invention. Our preferred power source is a capacitor, but other possible power sources are rechargeable batteries and batteries which are passive until activated.

The power source for the passive power storage device is at the surface where it can easily removed or replaced, and where any malfunction on its part can readily be made good. It may be, for example, a permanent power source such as a battery or an array of solar cells. On the other hand it itself may be a temporary power source or merely a receiving point for power transmitted from elsewhere, for example, through wiring or optical fibres, or via radio waves, electromagnetic induction or light, including laser light.

The means for communicating signals between the components of the system on the surface of the explosive and those within the explosive can be any convenient means available to the art. It may be, for example, a direct connection such as electrical wiring or optical fibre, or it may be via a form of radiation such as radio waves or electromagnetic induction. We prefer the direct connection because it is cheaper and it is easier (and again cheaper) to verify the status of the detonator.

The second delay element associated with the surface components capable of delaying the time between receipt of the firing signal at (b) and detonation may be selected from any suitable apparatus known to the art. It may, for example, have a fixed or a variable delay.

In one embodiment of our invention, the second delay element has a variable delay and the first delay element has a fixed delay. As the second delay element is present at the surface, it is relatively easy to alter the delay time by simply changing the second delay element itself. We prefer, however, that it be programmable, and more preferably remotely programmable. In a particularly preferred embodiment of our invention, the second delay element is remotely programmable and the first delay element is fixed. The embodiment confers considerable versatility on a blasting system; delays can be set at will and/or changed right up to the time of blasting, yet the fixed delay detonators are relatively inexpensive.

The signals for programming and firing may be communicated to the detonation means by any convenient method. It may be done, for example, by direct connection to a remote command source by wiring or optical fibres, or it may be done by "wireless" means, for example by radio or laser, or by a combination of these methods.

The invention will now be further described with reference to the appended drawing which schematically depicts a preferred embodiment wherein a remote command position gives instructions by means of radio transmission.

In this embodiment, components 1–5 are underground and are linked to the components on the surface by connecting wires 6. A fusehead 1, adapted to fire a detonator, is activated by an electronic power switch 2. This power switch is controlled by a logic unit 4 whose function is to decode valid signals which are received from the surface via the interface 5. This interface both conditions the signals from the surface for the logic unit 4 and extracts power to operate the underground components and fire the fusehead, this being stored in a temporary energy storage unit 3. Prior to use, the unit 3 contains no energy. The logic unit 4 comprises a fixed delay such that the unit will, on receiving a firing signal, retard firing by a fixed time.

The surface components which are directly connected to the underground components via the connecting wires 6 comprise an energy source 14 which is enabled by a switch 15 and which powers a line driver 7, a logic unit 8, a radio receiver 9 and a radio transmitter 10. The transmitter 10 and receiver 9 are connected to an antenna 11 which receives signals from and transmits confirmatory signals to a blast controller 13 which transmits and receives via an antenna 12. The logic unit 8 receives information from the receiver 9, decodes it and send it to the underground components via the line driver 7; it also confirms the receipt of the signal via the transmitter 10. In addition, the logic unit comprises a programmable delay which can be set to any suitable delay time by means of instructions transmitted from blast controller 13.

In practice, the blast controller would first transmit programming instructions to the surface components. These would be received by the logic unit 8 whose programmable delay is set by them. The logic unit 8 then acknowledges via the transmitter that programming has been completed. When the firing signal is sent, the logic unit 8 will delay its onward communication to the underground components the delay time previously programmed before sending it. On receipt of hhe firing signal from the surface components, the interface 5 will charge the temporary power source 3 and forward the signal to the logic unit 4. The delay within this unit will prevent the fusehead 1 from being fired until the fixed delay elapsed.

Persons skilled in the art will realise that has there are possible many variations which are within the knowledge of the art. For example, the underground logic unit 4 may comprise safety devices which disable the detonator safely prior to firing, should anything go wrong. A possible variation in the preferred embodiment hereinabove described is the omission of the transmitter which transmits confirmatory signals to the blast controller 13. This removes some of the versatility from the system, but makes it cheaper and simpler.

We claim:

1. A method of blasting wherein an explosive is detonated by detonation means responsive to a firing signal from a remote command source, the detonation means comprising (a) within the explosive a detonator, a first delay element associated therewith and capable of actuating the detonator at a prescribed time after receiving the firing signal and a passive power storage device, (b) at the surface of the explosive a power source, a means for receiving signals, and a second delay element associated therewith capable of delaying the time between receipt of the firing signal at (b) and detonation; and (c) means for communicating signals from (b) to (a).

2. A method of blasting according to claim 1, wherein the first and second delay elements have programmable delays.

3. A method of blasting according to claim 1, wherein the first and second delay elements have fixed delays.

4. A method of blasting according to claim 1, wherein the first delay element has a fixed delay and the second delay element has a programmable delay.

5. A method of blasting according to claim 4, wherein the programmable delay is remotely programmable.

6. A method of blasting according to claim 1, wherein the passive power source is a capacitor.

7. A blasting apparatus for use in the firing of an explosive charge, the apparatus comprising (a) within the explosive a detonator, a first delay element associated therewith and capable of actuating the detonator at a prescribed time after receiving the firing signal, and a passive power storage device, (b) at the surface of the explosive a power source, a means for receiving signals, and a second delay element associated therewith capable of delaying the time between receipt of the firing signal at (b) and detonation; and (c) means for communicating signals from (b) to (a).

8. A blasting apparatus according to claim 7, wherein the first and second delay elements have programmable delays.

9. A blasting apparatus according to claim 7, wherein the first and second delay elements have fixed delays.

10. A blasting apparatus according to claim 7, wherein the first delay element has a fixed delay and the second delay element has a programmable delay.

11. A blasting apparatus according to claim 10, wherein the programmable delay is remotely programmable.

12. A method of blasting according to claim 7, wherein the passive power source is a capacitor.

* * * * *